US007727047B2

(12) United States Patent
Lopez et al.

(10) Patent No.: US 7,727,047 B2
(45) Date of Patent: Jun. 1, 2010

(54) TOY AND METHOD OF TOY OPERATION

(76) Inventors: Julian Edward Lopez, 6320 Harbour Club Dr., Lake Worth, FL (US) 33467; Michael Yeung, 14/F, 73A Tai Kok Tsui Road, Kowloon, Hong Kong (CN)

( * ) Notice: Subject to any disclaimer, the term of this patent is extended or adjusted under 35 U.S.C. 154(b) by 736 days.

(21) Appl. No.: 11/418,222

(22) Filed: May 4, 2006

(65) Prior Publication Data

US 2006/0252339 A1 Nov. 9, 2006

Related U.S. Application Data

(60) Provisional application No. 60/677,628, filed on May 4, 2005.

(51) Int. Cl.
*A63H 27/14* (2006.01)

(52) U.S. Cl. ..... 446/429; 446/41

(58) Field of Classification Search ..... 173/217; 446/40, 41, 45, 429, 430, 38, 39, 43, 44
See application file for complete search history.

(56) References Cited

U.S. PATENT DOCUMENTS 1,835,786 A * 12/1931 Klaus ..... 446/39
3,859,749 A * 1/1975 Morin et al. ..... 446/145
4,107,871 A * 8/1978 Hornsby, Jr. ..... 446/41
4,204,359 A * 5/1980 Plo ..... 446/41
4,637,152 A * 1/1987 Roy ..... 40/495
5,362,065 A * 11/1994 Su ..... 473/511
5,390,763 A * 2/1995 Liedtke ..... 185/39
5,525,086 A 6/1996 Gentile et al.
6,273,200 B1 * 8/2001 Smith et al. ..... 173/216

* cited by examiner

*Primary Examiner*—John Ricci
(74) *Attorney, Agent, or Firm*—Michael Best & Friedrich LLP

(57) ABSTRACT

Some embodiments of the present invention provide a drive mechanism for launching a figurine. The drive mechanism can include a housing, a rotary drive supported in the housing and being drivingly engageable with the figurine for launching the figurine outwardly from the housing, and a locking element movable between a locked position, in which the locking element engages the rotary drive to prevent movement of the rotary drive with respect to the housing, and an unlocked position, in which the locking member is moved away from the rotary drive.

17 Claims, 7 Drawing Sheets

TOY AND METHOD OF TOY OPERATION

CROSS-REFERENCE TO RELATED APPLICATION

This application claims priority under 35 U.S.C. §119 to Provisional Patent Application Ser. No. 60/677,628 filed on May 4, 2005, the entire contents of which is hereby incorporated by reference.

FIELD OF THE INVENTION

The present invention relates to toys and, more particularly, to toys having locking devices and methods of operating such toys and locking devices.

BACKGROUND

Children continue to be fascinated by television, movie, and other characters that can fly or that have movement simulating flight. Similarly, children continue to be fascinated by flying toys and toys that launch objects into the air. For example, children have been building and playing with paper airplanes for decades.

SUMMARY

Some embodiments of the present invention provide a launchable figurine and a drive mechanism for launching a figurine. The drive mechanism can include a housing supporting a rotary drive having a drive shaft supporting a drive gear. The rotary drive can also include a driven shaft supporting a driven gear, which can be drivingly engaged with the drive gear to receive rotational motion from the drive gear, and can be operable to transfer rotational motion to the figurine.

In some embodiments, the invention also provides a launchable figurine and a drive mechanism having a locking device. The drive mechanism can include a housing supporting a rotary drive and one or more stops selectively engageable with the rotary drive to prevent or limit rotation of the rotary drive with respect to the housing. In some embodiments, the locking device can prevent launching of the figurine when one or more stops are engaged with the rotary drive.

In addition, some embodiments of the present invention provide a method of using a drive mechanism to launch a figurine. The drive mechanism can include a rotary drive and a locking device operable to prevent rotational movement of the rotary drive when the drive mechanism is oriented in a non-preferred orientation. The method can include moving the drive mechanism from a non-preferred orientation toward a preferred orientation, drivingly connecting the figurine to the drive mechanism, moving the locking device from a locked position in which the locking device prevents rotational movement of the rotary drive toward an unlocked position in which the locking device is moved away from the rotary drive, and transferring rotational motion from the rotary drive to the figurine.

Some embodiments of the present invention provide a drive mechanism for launching a figurine. The drive mechanism can include a housing, a rotary drive supported in the housing and being drivingly engageable with the figurine for launching the figurine outwardly from the housing, and a locking element movable between a locked position, in which the locking element engages the rotary drive to prevent movement of the rotary drive with respect to the housing, and an unlocked position, in which the locking member is moved away from the rotary drive.

The present invention also provides a method of operating a drive mechanism having a housing and a rotary drive supported in the housing. The method can include the acts of engaging a figurine with the rotary drive and moving the housing and the figurine together toward a first orientation with respect to ground to move a locking element into engagement with the rotary drive to prevent movement of the rotary drive with respect to the housing. The method can also include the acts of moving the housing and the figurine together toward a second orientation with respect to the ground to move the locking element away from the rotary element and launching the figurine upwardly away from the housing.

In addition, the present invention provides a method of operating a drive mechanism of a flying toy. The method can include the acts of providing a housing at least partially supporting a rotary drive, engaging a figurine with the rotary drive, and engaging the rotary drive with a locking element to prevent rotation of the rotary drive with respect to the housing when a longitudinal axis of the figurine is oriented at an angle with respect to ground that is less than a predetermined acute angle. The method can also include the acts of disengaging the locking element from the rotary drive to allow rotation of the rotary drive with respect to the housing when the longitudinal axis of the figurine is substantially normal to the ground, and launching the figurine upwardly away from the housing.

Other aspects of the invention will become apparent by consideration of the detailed description and accompanying drawings.

Figure 1:
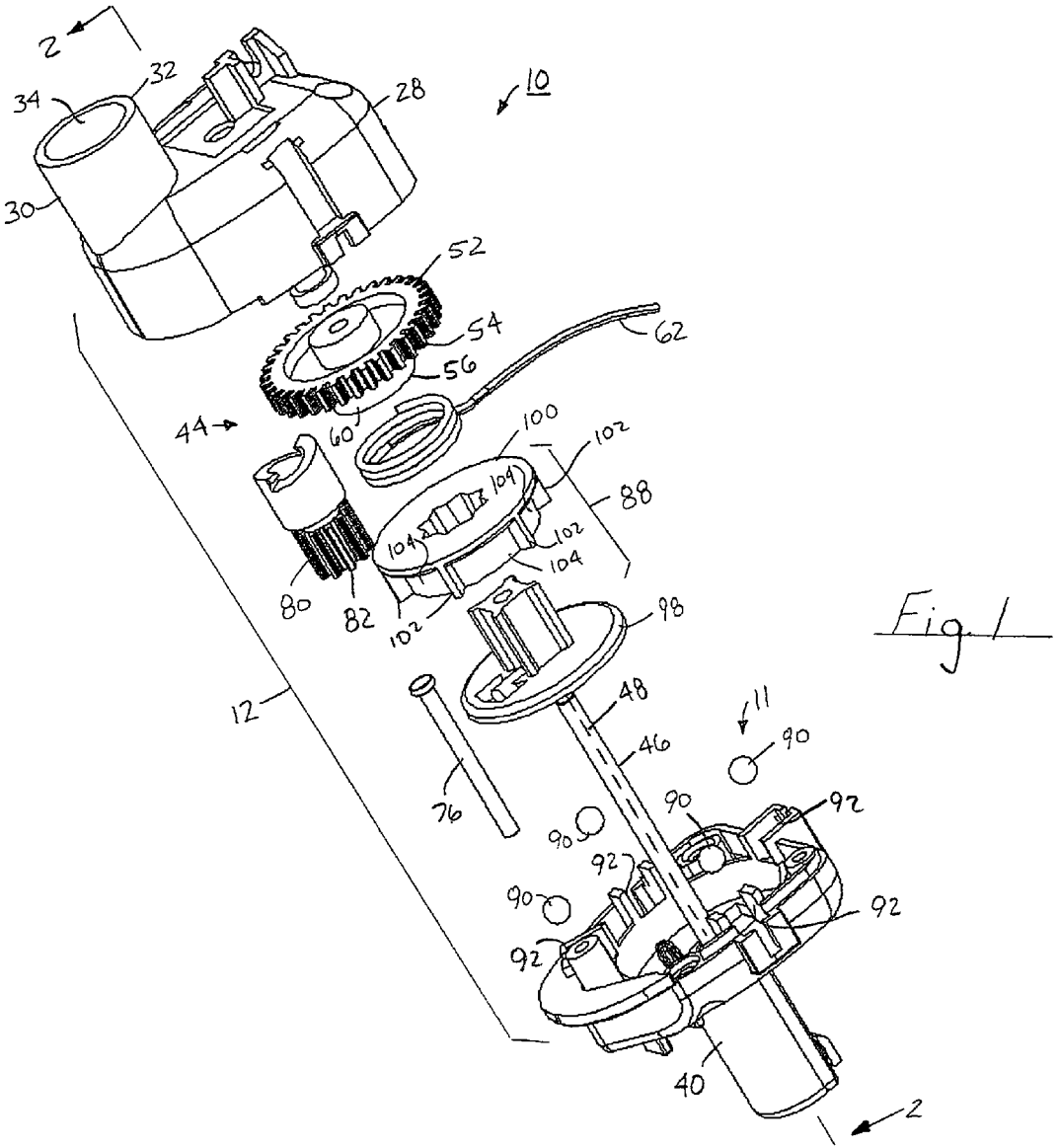
FIG. 1 is an exploded perspective view of a toy and a locking device according to an embodiment of the present invention, shown without a portion of the toy to be launched.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "upward", "downward", "outer", and the like) are only used to simplify description of the present invention, and do not alone indicate or imply that the device or element referred to must have a particular orientation. The toy and elements of the toy referred to in the present invention can be held and operated in a number of different orientations. In addition, terms such as "first" and "second" are used herein for purposes of description and are not intended to indicate or imply relative importance or significance.

DETAILED DESCRIPTION

FIGS. 1-7 illustrate a toy 10 and a locking device 11 according to an embodiment of the present invention. The toy 10 can include a drive mechanism 12 and a launchable figurine 14 (see, for example, FIG. 5) supported on the drive mechanism 12. A number of the elements of the drive mechanism 12 and figurine 14 are similar to those disclosed in U.S. Pat. No. 5,525,086, issued Jun. 11, 1996, the entire contents of which are incorporated herein by reference.

Figure 5:
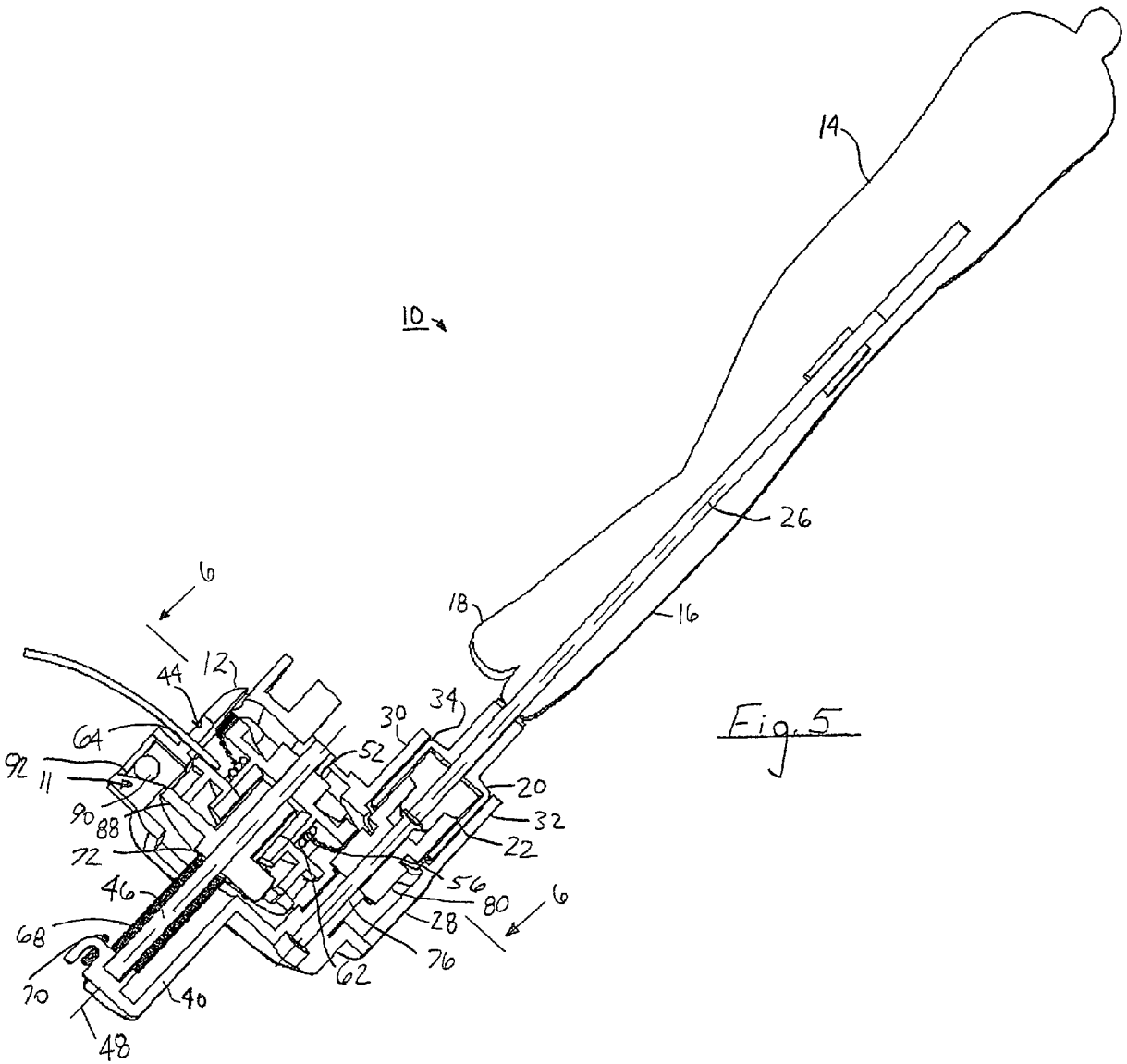
FIG. 5 is a sectional view of the toy and the locking device illustrated in FIGS. 1-4, shown with a portion of the toy to be launched.
Figure 6:
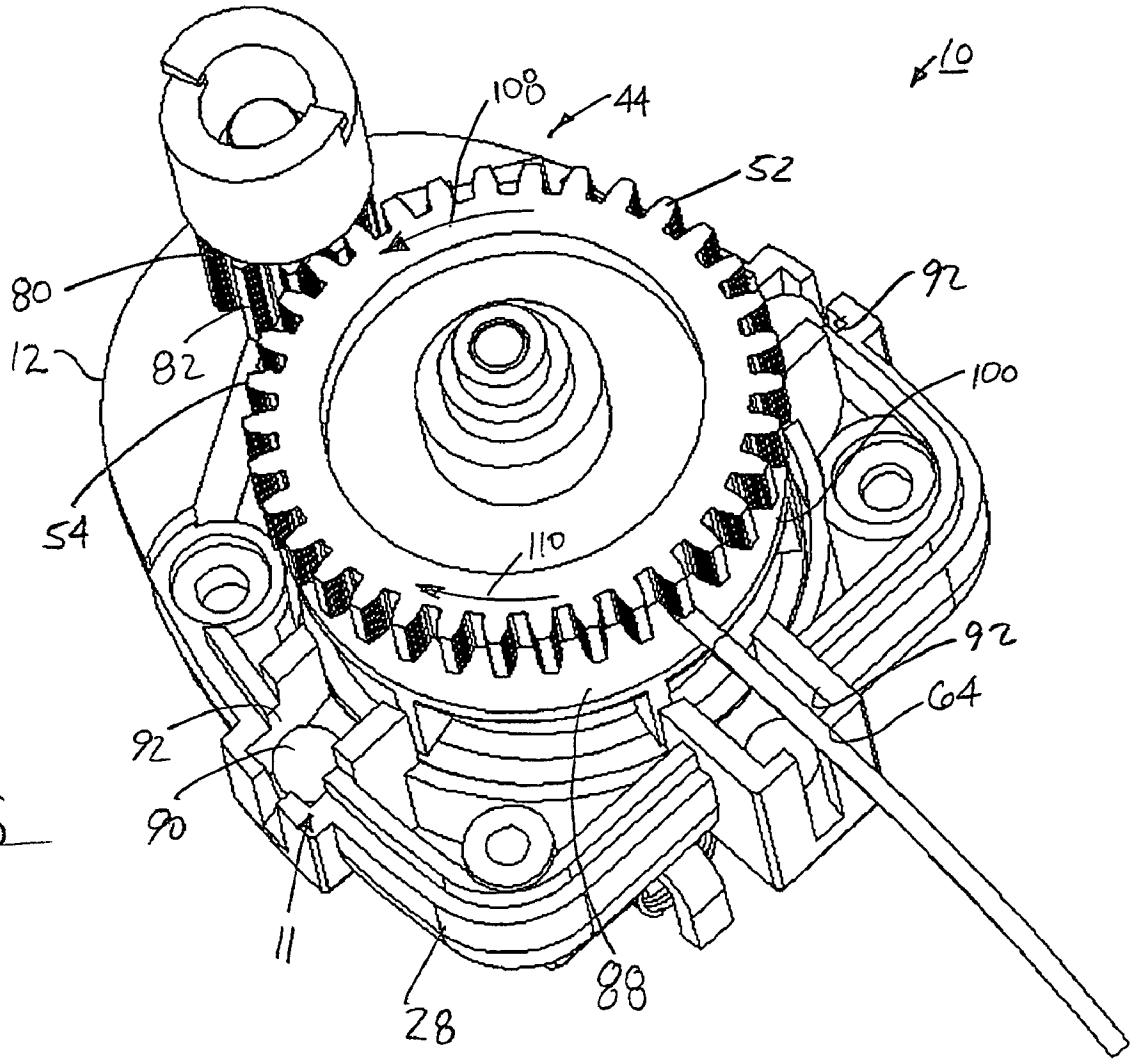
FIG. 6 is a sectional view of the toy and the locking device illustrated in FIGS. 1-5, taken along line 6-6 of FIG. 5.
Figure 7:
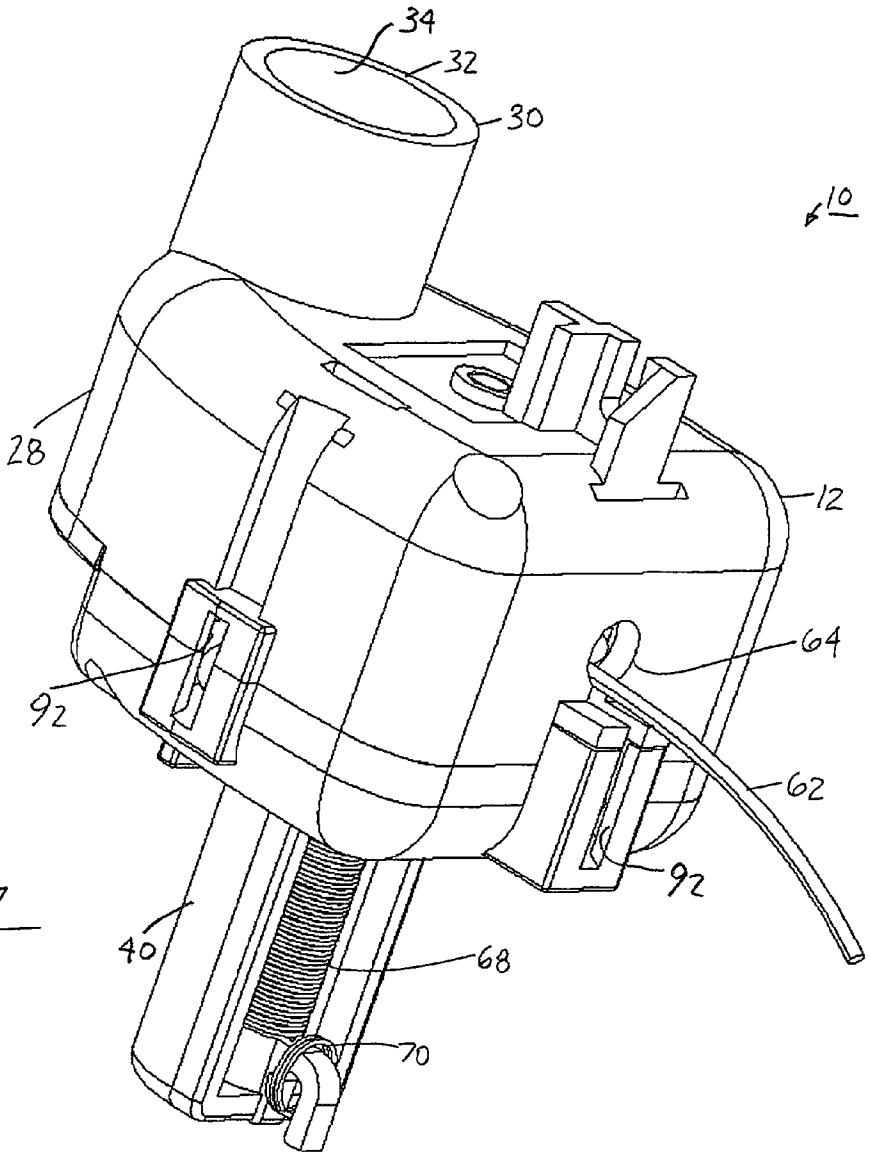
FIG. 7 is a perspective view of the toy shown in FIGS. 1-6, shown without a portion of the toy to be launched.

With reference to FIG. 5, the figurine 14 can include an elongated body 16 and wings 18, which can be pivotably connected to the body 16 for movement relative to the body 16 between deployed positions (not shown) and stowed positions (shown in FIG. 5). As also shown in FIG. 5, a lower end 20 of the body 16 can include a coupling 22 for releasable connection to the drive mechanism 12.

In some embodiments, the figurine 14 can be shaped to resemble a human, a human-like character, an animal, an animal-like character or another creature, such as, for example, a princess, an acrobat, a dancer, an angel, an elf, a bird, a butterfly, and the like. In other embodiments, the figurine 14 can be shaped to resemble a vehicle, such as a helicopter, a plane, a spaceship, and the like. In still other embodiments, the figurine 14 can have any other shape and can represent any other object or device desired. In those embodiments in which the figurine 14 is shaped to resemble a creature (e.g., a human), the wings 18 can be formed to resemble arms, and the coupling 22 can be formed to resemble human feet or shoes. In embodiments in which the figurine 14 is shaped to resemble a vehicle, the wings 18 can be formed to resemble rotor blades or airplane wings, and the coupling 22 can be formed to resemble tires, skis, and the like.

In the illustrated embodiment, the figurine 14 can be supported on the drive mechanism 12 for rotational movement about a first axis 26 (see FIG. 5) and relative to the drive mechanism 12. In these embodiments and as described in greater detail below, the body 16 and/or the coupling 22 can be rotated relative to the drive mechanism 12 before being launched upwardly and away from the drive mechanism 12, such as in a generally upward flight or launch path.

In some embodiments, the drive mechanism 12 includes a housing 28 having an engagement portion or coupling 30. As shown in FIGS. 1-7, the coupling 30 of the drive mechanism 12 can include an outer wall 32 at least partially defining a recess 34. With reference to FIG. 5, when the toy 10 is assembled, at least a portion of the coupling 22 of the figurine 14 can be inserted into the recess 34 and can be drivingly connected to the coupling 30 of the drive mechanism 12. Rotational motion can thereby be transferred from the drive mechanism 12 to the figurine 14. In other embodiments, a rotatable connection between the figuring 14 and the coupling of the drive mechanism 12 can be established by placement of an outer wall of the figurine 14 over an outer wall 32 of the coupling 30, or in other manners.

With continued reference to the illustrated embodiment, the drive mechanism 12 can include a handle or grip 40 that can be gripped or otherwise held by an operator. In some embodiments, the handle 40 extends from a lower portion of the housing 28 in a direction substantially parallel to the axis 26 of the figurine 14. In other embodiments, the handle 40 can be connected to the housing 28 in other locations and can have other orientations with respect to the coupling 30 of the drive mechanism 12 and with respect to the figurine 14.

In some embodiments, the drive mechanism 12 can include a rotary drive 44, which can transfer rotational motion from the drive mechanism 12 to the figurine 14 in order to launch the figurine 14 away from the drive mechanism 12. In the illustrated embodiment of FIGS. 1-7, for example, the rotary drive 44 includes an elongated drive shaft 46, which extends within the housing 28 and is supported for rotation relative to the housing 28 about a second axis 48.

As shown in FIGS. 1-7, a drive gear 52 can be mounted on the drive shaft 46 for rotation with the drive shaft 46 about the second axis 48. In some embodiments, the drive gear 52 can also include a number of radially extending teeth 54 and a hub 56.

In embodiments having a hub 56, the hub 56 can provide a spool or a reel 60 for receiving a pull string 62. As best shown in FIGS. 1, 2, 4, and 5, the pull string 62 can be wound around the reel 60 and can extend outwardly through an opening 64 in the housing 28 for manipulation by an operator.

In some embodiments, the rotary drive 44 of the present invention also includes a biasing member 68, such as, a spring or another elastic element. In operation, the biasing member 68 is coupled to the drive gear 52 and/or to the drive shaft 46, and is operable to exert a rotational force upon the drive gear 52 and/or to the drive shaft 46. In this manner, the drive gear 52 and/or drive shaft 46 can be rotated by the biasing member 68 about the second axis 48. In the illustrated embodiment of FIGS. 1-7, the biasing member 68 is located in the housing 28 and includes a first end 70 connected to the housing 28 and a second end 72 connected to the drive shaft 46. In other embodiments, the biasing member 68 can be connected to the housing 28 and the drive gear 52 or a portion of the locking device 11.

With continued reference to the embodiment of FIGS. 1-7, in some embodiments the rotary mechanism 44 can include an elongated driven shaft 76, which can be rotatable and located at least partially in the housing 28. In the illustrated embodiment, the driven shaft 76 is oriented to be substantially coaxial with the first axis 26 when the figurine 14 is connected to the drive mechanism 12. As shown in FIGS. 1-7, the driven shaft 76 can be positioned under the coupling 30 of the drive mechanism 12. In other embodiments, the driven shaft 76 can have other orientations relative to the coupling 30, and can be positioned in other positions within the drive mechanism 12.

A driven gear 80 can be supported on the driven shaft 76 or can be integrally formed with the driven shaft 76, and can include radially extending teeth 82. In the illustrated embodiment, the driven gear 80 is supported on the driven shaft 76 and is positioned and oriented in the housing 28 so that the teeth 82 of the driven gear 80 drivingly engage the teeth 54 of the drive gear 52. In this manner, rotational motion can be transferred from the drive gear 52 and the drive shaft 46 to the driven shaft 76 and the driven gear 80.

In some embodiments, the coupling 30 is rigidly connected or integrally formed with the driven shaft 76 and/or the driven gear 80. In this manner, the coupling 30 can rotate with the driven shaft 80 relative to the housing 28 about the first axis 26.

With continued reference to FIGS. 1-7 and as mentioned above, the toy 10 can include a locking device 11. In the illustrated embodiment, the locking device 11 is located in the housing 28, and includes a locking hub 88 and one or more locking elements or stops 90. As shown in FIGS. 1-7, the hub 88 can have a generally round cross-sectional shape. In other embodiments, the hub 88 can have any other cross-sectional shape, including without limitation oval, polygonal, irregular, and other cross-sectional shapes.

In some embodiments, such as the illustrated embodiment of FIGS. 1-7, the housing 28 or other portion of the drive mechanism defines one or more recesses or receptacles 92. As shown in FIGS. 1-7, the receptacles 92 can be spaced circumferentially around the second axis 48 and/or the drive shaft 46. The locking device 11 of the illustrated embodiment includes four locking elements or stops 90 supported in four receptacles 92, which are spaced circumferentially around the drive shaft 76 at ninety degree intervals. In other embodiments, the locking device 11 can include one, two, three, five, or more stops 90 supported in one, two, three, five, or more pockets 92, which can be spaced around the drive shaft 76 at regular or irregular intervals.

Figure 2:
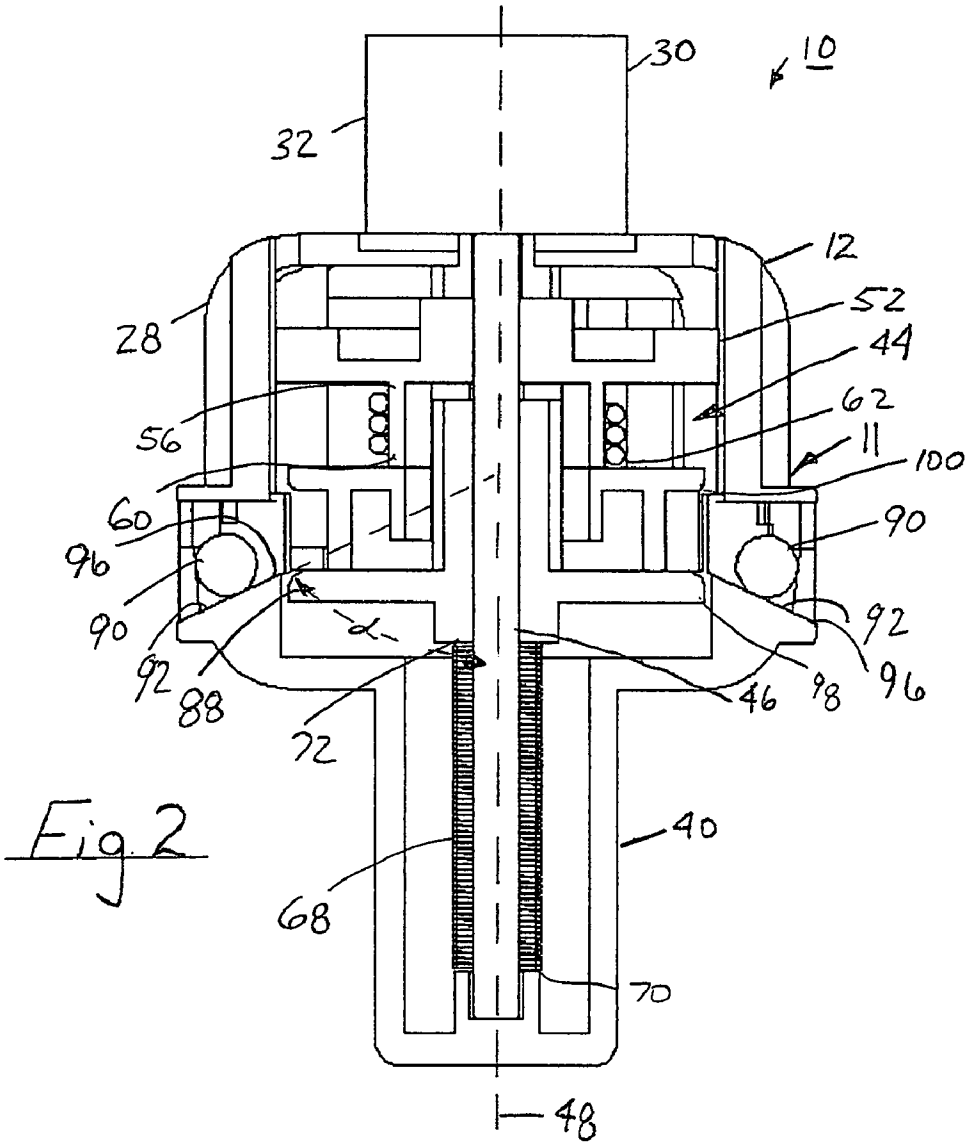
FIG. 2 is a sectional view of the toy and the locking device illustrated in FIG. 1, taken along line 2-2 of FIG. 1 and showing the locking device in an unlocked state.
Figure 3:
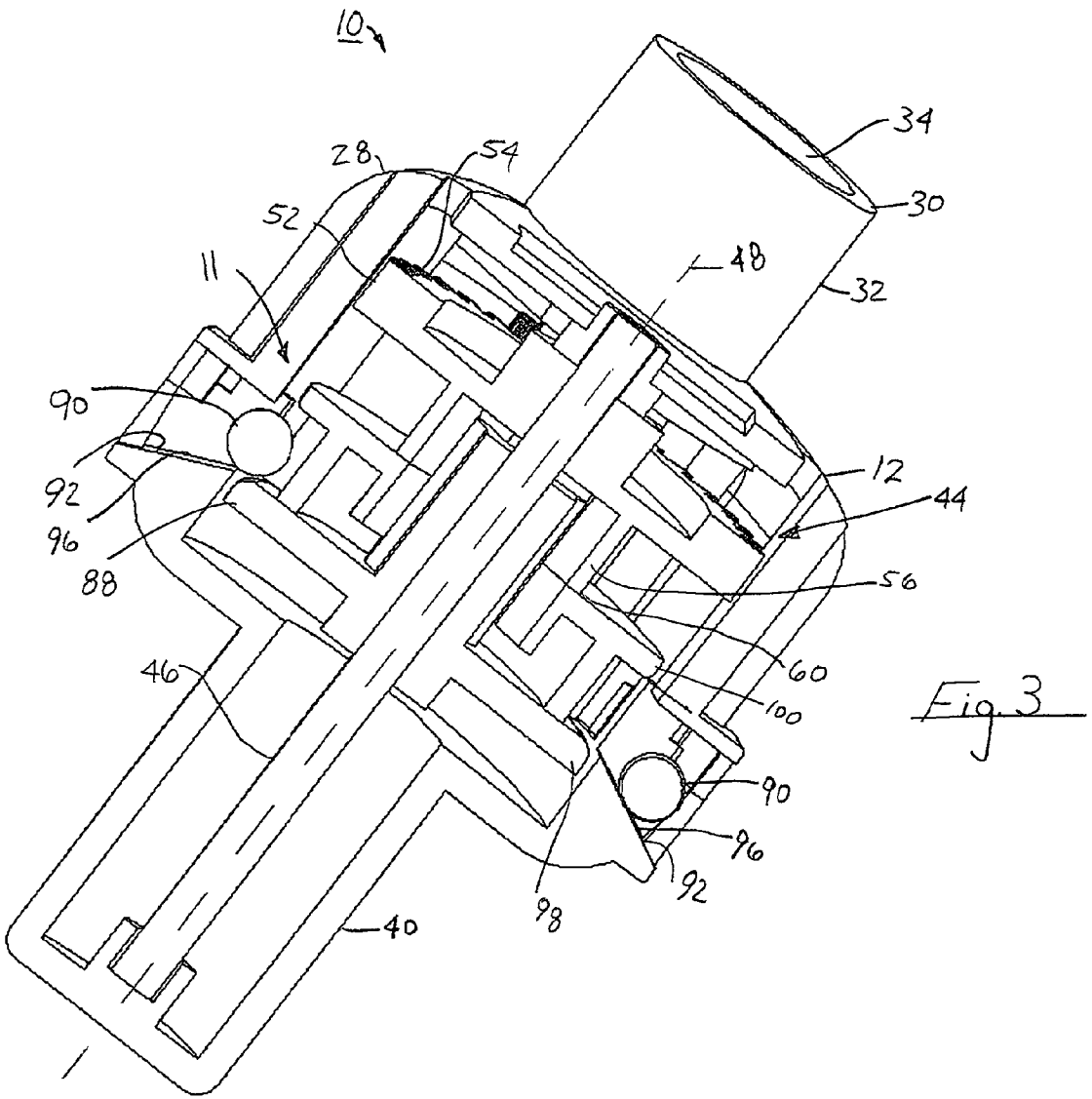
FIG. 3 is another sectional view of the toy and the locking device illustrated in FIGS. 1 and 2, taken along line 2-2 of FIG. 1 and showing the locking device in a locked state.

As shown in FIG. 2, one or more of the receptacles 92 can include a ramped surface 96, which can be oriented at an angle $\alpha$ with respect to the second axis 48. For example, in some embodiments, one or more ramped surfaces 96 can be oriented at an angle $\alpha$ of between about 10 degrees and about 80 degrees with respect to the second axis 48. In other embodiments, the ramped surfaces 96 can be oriented at an angle $\alpha$ of between about 20 degrees and about 70 degrees with respect to the first axis 26. In still other embodiments, the ramped surfaces 96 can be oriented at an angle $\alpha$ of between about 40 degrees and about 60 degrees with respect to the second axis 48.

As described in greater detail below, the stops 90 can be moveably supported in the receptacles 92 for movement (e.g., radial movement in the illustrated embodiment) between unlocked positions (shown in FIGS. 2, 5, and 6), in which the stops 90 are disengaged from the locking hub 88 and are positioned in the receptacles 92, and locked positions. Depending at least partially upon the circumferential locations of the stops 90 and the orientations of the ramped surfaces 96 (if used), two or more stops 90 can be in locked positions at the same time when the toy is oriented in one or more positions. In other embodiments, only a single stop 90 can be in a locked position at any given time. When a stop 90 is moved toward the locking hub 88 (i.e., toward a locked position), a portion of the stop 90 extends outwardly from its corresponding receptacle 92 and can be engaged with the locking hub 88 to prevent rotation of the locking hub 88 and the drive shaft 46 about the second axis 48.

In embodiments (such as the illustrated embodiment) in which the receptacles 92 include ramped surfaces 96, the angle $\alpha$ of each ramped surface 96 can be selected so that gravity moves the stops 90 downwardly along the ramps 96 toward respective unlocked positions when the toy 10 is held in a preferred operating orientation (e.g., so that the first axis 26 is substantially perpendicular to the ground) and so that gravity moves at least one of the stops 90 upwardly along the ramps 96 toward a locked position when the toy 10 is held in a non-preferred operating orientation (e.g., so that the first axis 26 is oriented at an angle of less than 80 degrees or more than 100 degrees with respect to the ground).

In this manner, the locking device 11 can render the rotary drive 44 inoperable when the drive mechanism 12 is held in a non-preferred orientation. For example, in some embodiments, the locking device 11 can prevent operation of the rotary drive 44 when the drive mechanism 12 is held in a substantially horizontal orientation in which an axis 26 of the body 16 of a figurine 14 releasably coupled to the drive mechanism 12 is substantially parallel to or at an acute angle with respect to the ground. Alternatively, when the drive mechanism 12 is held in a substantially vertical orientation in which an axis 26 of the body 16 of a figurine 14 releasably coupled to the drive mechanism 12 is substantially perpendicular to the ground, the locking device 11 is moved toward an unlocked state so that the rotary drive 44 can transfer rotational motion to the figurine 14.

In such embodiments, the locking device 11 can prevent operators from aiming the figurine 14 in a generally horizontal direction (and depending upon the circumferential locations of the stops 90 and the orientations of any ramps 96, in a range of angles with respect to the ground) toward another person and then launching the figurine 14 at the other person. Similarly, when the operator reorients the drive mechanism 12 and the figurine 14 to a preferred operating orientation (e.g., so that the figurine 14 is oriented at an angle of more than about 80 degrees and less than about 100 degrees with respect to the ground), the stops 90 are moved toward unlocked positions so that the rotary drive 44 can transfer rotational motion to the figurine 14 in order to launch the figurine 14.

Figure 4:
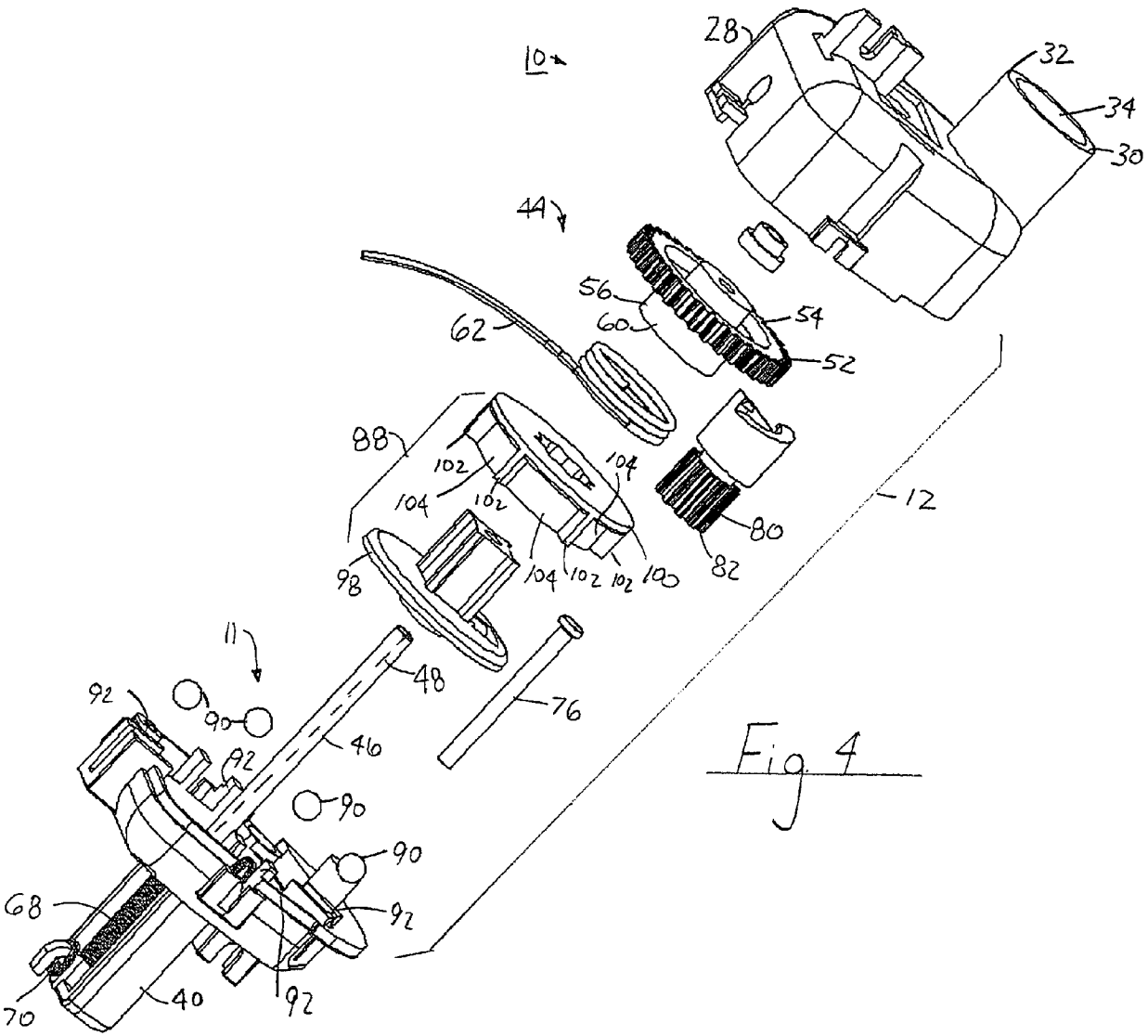
FIG. 4 is another exploded perspective view of the toy and the locking device illustrated in FIGS. 1-3.

In some embodiments, the locking hub 88 can be supported on the drive shaft 46 and can include a first or lower locking member 98 and a second or upper locking member 100 connected to the first locking member 98 for rotational movement with the first locking member 98 about the second axis 48. As shown in FIGS. 1 and 4, at least one protrusion 102 can extend axially between the first locking member 98 and the second locking member 100. Together, the protrusion 102, the first locking member 98, and the second locking member 100 at least partially define a locking recess 104. In the illustrated embodiment of FIGS. 1-7, the locking hub 88 includes four protrusions 102, which partially define four locking recesses 104. As shown in FIGS. 1-7, the locking recesses 104 can be spaced circumferentially around the locking flange 88 at intervals of approximately 90 degrees. In other embodiments, one, two, three, five, or more locking recesses 104 can be defined by protrusions 102 at any regular or irregular interval about the circumference of the locking hub 88. Also, in some embodiments the locking hub 88 is constructed of a single integral element or three or more elements coupled together in any manner, and can have other shapes in which recesses 104 capable of receiving one or more stops 90 are defined.

In operation, an operator can grasp the handle 40 of the drive mechanism 12 with a first hand. The figurine 14 can be placed on the drive mechanism 12, and the lower end 20 of the body 16 can be inserted into the recess 34 in the housing 28. The coupling 22 of the figurine 14 can then be drivingly connected to the coupling 30 of the drive mechanism 12.

The operator can then orient the drive mechanism 12 and the figurine 14 in a preferred operating orientation (e.g., so that the first axis 26 and the body 16 of the figurine 14 are substantially perpendicular to the ground). As the drive mechanism 12 is moved toward the preferred operating orientation, the stops 90 move relative to the housing 28 toward their respective unlocked positions.

Once the figurine 14 is drivingly connected to the drive mechanism 12 and the drive mechanism 12 and the figurine 14 are in a preferred operating orientation, the operator can grasp an end of the pull string 62 with a second hand and pull the string 62 outwardly away from the housing 28. As the pull string 62 is pulled outwardly, the pull string 62 can impart rotational motion to the drive shaft 46 and the drive gear 52 supported on the drive shaft 46, causing the drive gear 52 and the drive shaft 46 to rotate about the second axis 48 in a first rotational direction (represented by arrow 108 in FIG. 6). In addition, as the pull string 62 rotates the drive shaft 46, the biasing member 68 can be moved from a first rotational position toward a second rotational position.

Rotational motion can then be transferred from the drive gear 52 to the driven gear 80, causing the driven gear 80 and the driven shaft 76 to rotate about the first axis 26. As the driven shaft 76 rotates about the first axis 26, the coupling 30 of the drive mechanism 12 can transfer rotational motion to the coupling 22 of the figurine 14, causing the figurine 14 to rotate about the first axis 26. Rotation of the figurine 14 can cause free ends of the wings 18 to pivot centrifugally outwardly away from the first axis 26 and toward respective extended positions. When a sufficient rotational velocity is achieved, the wings 18 can act as airfoils to lift the figurine 14 away from the drive mechanism 12.

After the figurine 14 is launched, the operator can release the pull string 62. The biasing element 68 can then return from the second rotational position to the first rotational position, causing the drive shaft 46 to rotate about the second axis 48 in a second rotational direction (represented by arrow 110 in FIG. 6). As the drive shaft 46 rotates in the second rotational direction 110, the pull string 62 can be pulled into the housing 28 and can be wound around the reel 60.

The foregoing detailed description describes only a few of the many forms that the present invention can take and should, therefore, be taken as illustrative rather than limiting.

What is claimed is:

1. A drive mechanism for launching a figurine, the drive mechanism comprising:

a housing including a hub;

a rotary drive supported in the housing and being drivingly engageable with the figurine for launching the figurine outwardly from the housing; and a plurality of locking elements positioned around a perimeter of the hub, each locking element movable between a locked position, in which one of the locking elements engages the rotary drive to prevent movement of the rotary drive with respect to the housing, and an unlocked position, in which one of the locking elements is moved away from the rotary drive, wherein the rotary drive includes a spring-biased pull string.

2. The drive mechanism of claim 1, wherein one of the locking elements is movable toward the locked position when the housing is in a non-preferred orientation with respect to ground.

3. The drive mechanism of claim 2, wherein, when the housing is in the non-preferred orientation, a longitudinal axis of the figurine is at an angle of less than about 80 degrees with respect to the ground.

4. The drive mechanism of claim 1, wherein one of the locking elements is movable toward the unlocked position when the housing is in a launch orientation with respect to ground.

5. The drive mechanism of claim 4, wherein, when the housing is in the launch orientation, a longitudinal axis of the figurine is substantially perpendicular to the ground.

6. The drive mechanism of claim 1, wherein the perimeter is substantially circular.

7. The drive mechanism of claim 1, wherein, one of the housing and the rotary drive includes a ramp oriented at an acute angle with respect to a longitudinal axis of the figurine, and wherein one of the locking elements is movable along the ramp between the locked position and the unlocked position.

8. The drive mechanism of claim 7, wherein the locking element moves along the ramp toward the locked position when the housing is in a first orientation, in which the axis is at an angle of between about zero and about 80 degrees with respect to ground, and wherein the locking member moves along the ramp toward the unlocked position when the housing is in a second orientation, in which the axis is substantially perpendicular to the ground.

9. The drive mechanism of claim 1, wherein when one of the locking elements is in the locked position, the locking element is wedged between the housing and the rotary drive.

10. A method of operating a drive mechanism having a housing and a rotary drive supported in the housing, the method comprising:

engaging a figurine with the rotary drive;

moving the housing and the figurine together toward a first orientation with respect to ground to move a locking element into engagement with the rotary drive to prevent movement of the rotary drive with respect to the housing;

moving the housing and the figurine together toward a second orientation with respect to the ground to move the locking element away from the rotary element; and launching the figurine upwardly away from the housing, wherein moving the housing and the figurine together toward the first orientation with respect to the ground includes moving the locking element along a ramp supported in the housing.

11. The method of claim 10, wherein the figurine defines a longitudinal axis, and wherein launching the figurine includes rotating the figurine about the axis.

12. The method of claim 11, wherein moving the housing and the figurine together toward the first orientation includes orienting the figurine such that the longitudinal axis is at an acute angle with respect to the ground, and wherein moving the housing and the figurine together toward the second orientation includes orienting the figurine such that the longitudinal axis is substantially perpendicular to the ground.

13. The method of claim 12, wherein the acute angle is between about zero degrees and about 80 degrees.

14. The method of claim 10, wherein the figurine defines a longitudinal axis, wherein moving the housing and the figurine together toward the first orientation includes orienting the figurine such that an angle defined between the longitudinal axis and the ground is less than a predetermined angle, and wherein moving the housing and the figurine together toward the second orientation includes orienting the figurine such that the angle defined between the longitudinal axis and the ground is greater than the predetermined angle.

15. A method of operating a drive mechanism of a flying toy, the method comprising:

providing a housing at least partially supporting a rotary drive;

engaging a figurine with the rotary drive;

engaging the rotary drive with a locking element to prevent rotation of the rotary drive with respect to the housing when a longitudinal axis of the figurine is oriented at an angle with respect to ground that is less than a predetermined acute angle;

disengaging the locking element from the rotary drive to allow rotation of the rotary drive with respect to the housing when the longitudinal axis of the figurine is substantially normal to the ground; and launching the figurine upwardly away from the housing, wherein engaging the rotary drive with the locking element includes moving the locking element substantially radially and along a ramp supported in the housing.

16. The method of claim 15, wherein the predetermined acute angle is about 80 degrees.

17. The method of claim 15, wherein the drive mechanism includes a plurality of locking elements supported in the housing adjacent to the rotary drive, and wherein engaging the rotary drive with the locking element includes moving at least one of the plurality of locking elements into locking engagement with the rotary drive.

* * * * *